United States Patent [19]

Kagawa et al.

[11] Patent Number: 4,914,343

[45] Date of Patent: Apr. 3, 1990

[54] SPARK PLUG WITH COUNTERELECTRODE HAVING PLURAL APERTURES IN FLAT PORTION THEREOF

[75] Inventors: Junichi Kagawa; Wataru Matsutani, both of Aichi, Japan; Alfred Krappel, Ismaning, Fed. Rep. of Germany; Josef Holzmann, Munich, Fed. Rep. of Germany; Johannes Guggenmos, Fürstenfeldbruck, Fed. Rep. of Germany

[73] Assignees: NGK Spark Plug Co., Ltd., Aichi, Japan; Bayerische Motoren Werke A.G., Munich, Fed. Rep. of Germany

[21] Appl. No.: 288,920

[22] Filed: Dec. 23, 1988

[30] Foreign Application Priority Data

Dec. 25, 1987 [JP] Japan ..... 62-326891

[51] Int. Cl.[4] ..... H01T 13/32

[52] U.S. Cl. ..... 313/139; 313/141; 313/142

[58] Field of Search ..... 313/139, 141, 142

[56] References Cited

U.S. PATENT DOCUMENTS

| | | | |
|---|---|---|---|
| 1,360,294 | 11/1920 | Hill | 313/139 X |
| 2,047,575 | 7/1936 | Burtnett | 313/139 X |
| 2,139,793 | 12/1938 | Benton | 313/142 |
| 2,150,728 | 3/1939 | Nowosielski | 313/141 X |
| 2,206,073 | 7/1940 | Benton . | |
| 2,298,504 | 10/1942 | Ost | 313/139 X |
| 2,299,924 | 10/1942 | Ost | 313/139 X |

FOREIGN PATENT DOCUMENTS 99596 6/1923 Switzerland .

*Primary Examiner*—Palmer C. DeMeo

*Attorney, Agent, or Firm*—Sughrue, Miòn, Zinn, Macpeak & Seas

[57] ABSTRACT

The outer or side electrode of a spark plug is configured as a flat plate confronting the center electrode to define a gap, and fixed to the threaded shell or body of the plug by a plurality of spider legs. A plurality of holes are formed in the plate to improve the plug durability and retard any discharge voltage increases.

4 Claims, 3 Drawing Sheets

SPARK PLUG WITH COUNTERELECTRODE HAVING PLURAL APERTURES IN FLAT PORTION THEREOF

BACKGROUND OF THE INVENTION

This invention relates to a spark plug for an internal combustion engine, and particularly to such a plug having a grounded side electrode.

A conventional spark plug consists of a shell threaded to fit a hole in a cylinder head, a center and a side electrode which define a spark gap, and an insulator which serves as a bushing, for efficiently conducting high voltage from an outer terminal to the spark gap exposed in the combustion chamber. Usually, the shaped side electrode is welded to the shell, and then bent to form a spark gap facing the tip of the center electrode. To deal with electrode wear, a multi-pole spark plug fitted with a plurality of L-shaped side electrodes is available. Also available is a spark plug fitted with a flat plate that has a hole in the area facing the tip of the center electrode, and which is connected to the shell by a plurality of legs. An example of such a plug is shown in FIGS. 3(A) and 3(B), wherein the side electrode is generally indicated at 1. It is made of a conductive metal such as a Ni base alloy, and consists of a flat plate portion 3 with a center hole 2 facing the center electrode 5, and a plurality of legs 4 which are connected to the shell 6 to form a unitary assembly.

The spark plug shown in FIG. 3 has been developed in an attempt to improve the durability and anti-vibrational properties of the side electrode, and to attain good firing conditions. Good firing conditions are attained if the difference between the diameter of the center electrode and that of the hole in the side electrode is no smaller than 0.7 mm. However, durability tests conducted on this spark plug have revealed that a marked increase in discharge voltage occurs as a result of cyclic use. The durability tests have also indicated the possibility of cracking of the area between the periphery of the flat plate and the center hole in the side electrode.

SUMMARY OF THE INVENTION

An object, therefore, of the present invention is to provide a spark plug fitted with a side electrode that has improved durability to ensure good firing conditions at all times.

This object is achieved by a spark plug fitted with a side electrode that consists of a flat plate portion with a plurality of holes that faces the tip of a center electrode, and the periphery of which is connected to the shell by a plurality of legs to form a unitary assembly.

In a preferred embodiment the plurality of holes in the flat plate portion are spaced equidistantly around the center of the flat plate portion, and the diameter of each of these holes and the diameter of the circle inscribed among them are smaller than the outside diameter of the tip of the center electrode, with the total area of the holes being larger than the area of the inscribed circle.

The side electrode features a balanced structure in that its flat plate portion is securely supported by the plurality of legs, which contributes to improved durability and anti-vibrational properties. In addition, the holes in the flat plate portion have dimensions that are adapted to the outside diameter of the tip of the center electrode, and they are arranged in an optimum way, as confirmed by experiments, that good firing conditions are attained at all times to keep the discharge voltage at satisfactorily low levels. This enables the plug to be used for a prolonged period with reduced chance of misfiring.

DETAILED DESCRIPTION OF THE PREFERRED EMBODIMENTS

Figure 1A:
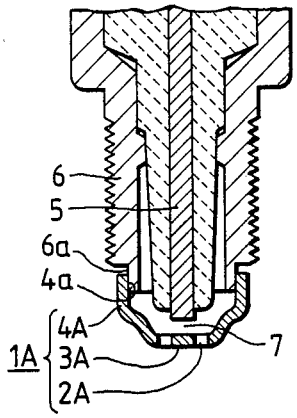
FIG. 1 is a longitudinal section showing the essential parts of the tip of a spark plug according to a first embodiment of the invention.
FIG. 1(B) is a bottom view of the plug.
Figure 1B:
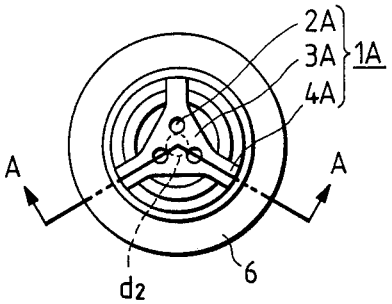

Referring to FIGS. 1(A) and 1(B), the side electrode is generally indicated by 1A and consists of a flat plate portion 3A having three equal diameter holes 2A spaced equidistantly around its center, and three legs 4A extending outwardly from the flat plate portion. The inner surface **4*a* of each leg 4A is connected to the peripheral side 6*a* of the shell 6. A spark gap 7 is defined by the tip surface of the center electrode 5 and the inner surface of the side electrode 1A**.

Figure 2A:
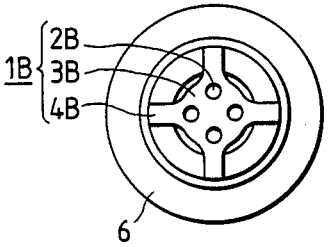
FIG. 2(A) is a bottom view of a spark plug according to a second embodiment of the invention.

FIG. 2(A) is a bottom view of a second embodiment, in which four equal diameter holes 2B are formed in the flat plate portion B of a side electrode 1B, with the flat plate portion connected to the shell 6 via four legs 4B. The other components are the same as those shown in the first embodiment.

The holes 2A or 2B are formed such that the following conditions are satisfied:

$$d_2 < d_1;\ d_3 < 1;\ n(d_3)^2 \geqq (d_1)^2 > (d_2)^2,$$

where $d_1$ is the outside diameter of the tip of the center electrode 5, $d_2$ is the diameter of the circle inscribed along the holes, $d_3$ is the diameter of each hole, and n is the number of the holes.

Figure 2B:
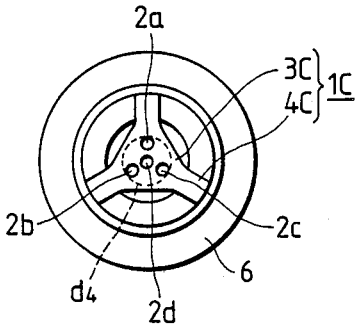
FIG. 2(B) is a bottom view of a spark plug according to a third embodiment of the invention.

FIG. 2(B) is a bottom view of a third embodiment, wherein the side electrode 1C has a flat plate portion in which four holes **2*a*, 2*b*, 2*c* and 2*d* of different diameter are made, with the first three holes being spaced around the center hole 2*d*. The holes 2*a*, 2*b* and 2*c* are desirably within a circle concentric to the center electrode, and whose diameter $d_4$ is no more than 2.5 $d_1$. If $d_4$ is unduly large, the distance from each of the holes 2*a*, 2*b* and 2*c*** to the periphery of the flat plate portion is so decreased as to cause potential overheating. Furthermore, the ability of the plug to retard an increase in discharge voltage is impaired. The holes in the flat plate portion desirably satisfy the following condition:

$$\sum_{i=1} n_1(d_1)^2 \geqq (d_1)^2$$

wherein $n_1$ signifies the number of holes, and $d_1$ is the diameter of each hole. In order to assure high strength and ease of machining, two adjacent holes are desirably spaced apart by a distance of at least 1 mm.

Figure 3A:
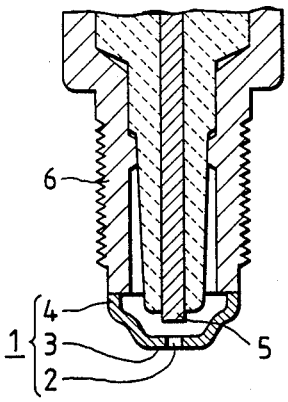
FIG. 3A PRIOR ART
FIG. 3(A) is a longitudinal section showing the essential parts of the tip of a prior art spark plug.
Figure 3B:
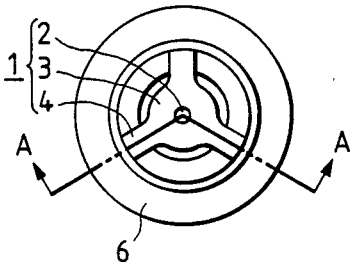
FIG. 3B PRIOR ART
FIG. 3(B) is a bottom view of the plug.
Figure 4:
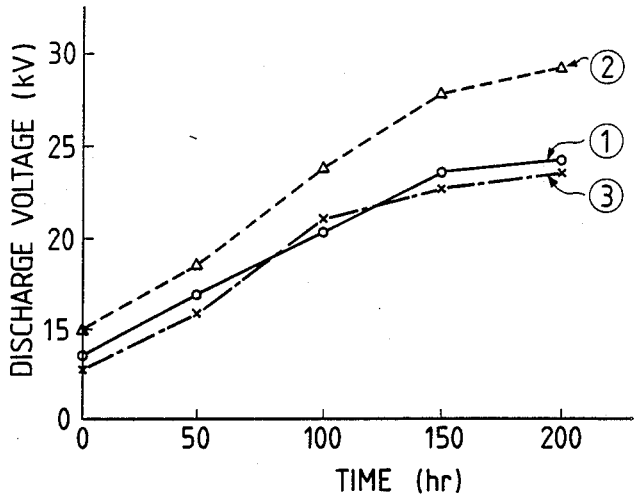
FIG. 4 is a graph showing the discharge voltage vs. durability test time of the spark plugs according to the first and third embodiments of the invention as compared with the prior art plug.

The spark plug according to the first embodiment and the prior art plug depicted in FIG. 3 were subjected to a durability test with an engine operating on a bench at 5,500 rpm×4/4 (at full throttle) for a period of 200 hours. Discharge voltage measurements were conducted over the range of engine operation from idling to a racing condition (acceleration up to 5,000 rpm with no load applied). The results are shown in FIG. 4, in which curve (1) plots the results obtained with the spark plug of the first embodiment under such conditions that $n=3$, $d_1=2.5$ mm, $d_3=1.6$ mm and the distance between holes being 1 mm (in this case, $d_2=1.4$ mm), and curve (2) plots the results obtained with the prior art plug under such conditions that $n=1$, $d_1=2.5$ mm, and $d_3=3.0$ mm. The discharge voltage was substantially lower with the spark plug of the first embodiment than with the prior art version, and this indicates the improved durability of the former plug. The same test was conducted on the spark plug according to the second embodiment and the results were similar to those obtained with the first embodiment, so they are not shown in FIG. 4. The test results with the spark plug according to the third embodiment are indicated by curve (3) in FIG. 4.

Figure 5:
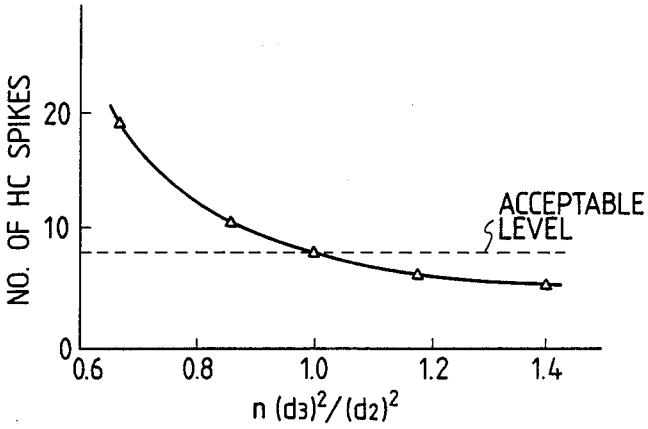
FIG. 5 is a graph showing the number of HC spikes occurring in the spark plug of the first embodiment of the invention as a function of the total area of the holes made in the side electrode.

In order to investigate the relationship between the total area of holes in the flat plate portion of the side electrode and the firing conditions, the spark plug according to the first embodiment wherein $d_1=2.5$ mm and $n=3$ was subjected to an idling test with the engine operating at an air/fuel ratio of 14 with the ratio of $n(d_3)^2$ to $(d_2)^2$ being adjusted to various values. The number of HC spikes (the number of hydrocarbon peaks) occurring at each ignition was counted and plotted in FIG. 5. Good firing conditions require a minimum number of HC spikes and a standard spark plug such as BCP 6ES performs with 8 HC spikes. If this value is taken as a criterion, FIG. 5 shows that good results are attained by satisfying the condition $$n(d_3)^2/(d_2)^2 > 1 \text{ or } n(d_3)^2 \geqq (d_2)^2.$$

The provision of more than one hole in the flat plate portion of the side electrode also contributes to a more uniform distribution of thermal stresses, thereby preventing the occurrence of cracking in the flat plate. In the prior art spark plug which has only one hole formed in the center of the flat plate portion of the side electrode, it has been necessary to achieve precise alignment between the single hole and the axis of the center electrode to stabilize the discharge voltage and prevent abnormal or uneven wear that might occur in the presence of misalignment. Needless to say, it is desirable that the center of the group of holes in the side electrode of the spark plug of the invention are in registry with the axis of the center electrode, but the tolerance that is required is not as close as what must be observed by the prior art plug. Therefore, the spark plug of the invention has the additional advantage of being manufactured with relative ease.

What is claimed is:

1. In a spark plug comprising a cylindrical shell (6), an insulator, a center electrode (5) extending axially through the insulator with a tip thereof protruding therefrom, and a side electrode having a centered flat plate portion facing the tip of said center electrode to form a spark gap (7) between said tip and said flat plate portion, the periphery of said flat plate portion being joined to the shell via a plurality of legs, the improvement wherein a plurality of holes are made in said flat plate portion.

2. A spark plug according to claim 1, wherein the plurality of holes have the same diameter and are spaced equidistantly around a center of said flat plate portion, with the diameter of each hole and that of a circle inscribed by said holes being smaller than an outside diameter of the tip of said center electrode, and with a total area of said holes being larger than an area of said inscribed circle.

3. A spark plug according to claim 2, wherein the number of said holes is three.

4. A spark plug according to claim 1, wherein said plurality of holes have different diameters, and lie within a circle concentric to the center electrode and whose diameter is no more than 2.5 times the diameter of the center electrode.

* * * * *